US009422730B2

(12) United States Patent
Curtis et al.

(10) Patent No.: US 9,422,730 B2
(45) Date of Patent: Aug. 23, 2016

(54) TRIM SYSTEM

(71) Applicants: SILVERWOOD STONE CORP., Fredericton (CA); 8906912 CANADA INC., Kensington (CA)

(72) Inventors: Caleb Curtis, Fredericton (CA); Barry Curtis, Fredericton (CA)

(73) Assignees: Silverwood Stone Corp., Fredericton (CA); 8906912 Canada, Inc., Kensington (CA)

( * ) Notice: Subject to any disclaimer, the term of this patent is extended or adjusted under 35 U.S.C. 154(b) by 0 days.

(21) Appl. No.: 14/565,648

(22) Filed: Dec. 10, 2014

(65) Prior Publication Data

US 2016/0168869 A1 Jun. 16, 2016

(51) Int. Cl.

| | |
|---|---|
| ***E04C 2/38*** | (2006.01) |
| ***E04F 19/02*** | (2006.01) |
| ***E04B 1/41*** | (2006.01) |
| *E04B 1/38* | (2006.01) |

(52) U.S. Cl.

CPC ..... *E04F 19/024* (2013.01); *E04B 1/40* (2013.01); *E04B 2001/405* (2013.01); *E04F 2290/00* (2013.01)

(58) Field of Classification Search

CPC ..... E04F 21/0092; E04F 21/22; E04F 19/024; E04F 2290/00; E06B 1/04; E04B 1/40; E04B 2001/405

USPC ..... 52/716.2, 716.4, 716.8, 718.04, 211

See application file for complete search history.

(56) References Cited

U.S. PATENT DOCUMENTS

| | | | | | |
|---|---|---|---|---|---|
| 3,142,938 | A * | 8/1964 | Eberhardt | E04B 2/845 | 52/385 |
| 3,331,180 | A * | 7/1967 | Vissing | E04B 9/22 | 411/457 |
| 4,641,473 | A * | 2/1987 | Trezza | E04F 13/0846 | 52/410 |
| 4,956,949 | A * | 9/1990 | Francis | E04F 13/0821 | 52/38 |
| 5,373,676 | A * | 12/1994 | Francis | E04F 13/0862 | 52/386 |
| 5,501,049 | A * | 3/1996 | Francis | E04F 13/0862 | 52/315 |
| 6,050,037 | A * | 4/2000 | Gifford | E06B 1/62 | 52/211 |
| 8,490,350 | B1 * | 7/2013 | Greely | E06B 1/04 | 52/211 |
| 8,607,514 | B2 | 12/2013 | Peterson | | |
| 2012/0222383 | A1 | 9/2012 | Cashman | | |

* cited by examiner

*Primary Examiner* — Basil Katcheves

(74) *Attorney, Agent, or Firm* — Cherskov Flaynik & Gurda, LLC

(57) ABSTRACT

The trim system is comprised of a J-trim component to be secured onto a surface such as a wall of a home, and a ledge component to be secured within said J-trim component. The ledge component is comprised of a slot along a longitudinal axis of the ledge member in order to mate with a hook portion of the J-trim component, and is also comprised of keyholes on the lower surface of said ledge member in order to secure it to the wall as well. The ledge member has two leader grooves located on opposite extremities of the slot in order to reduce the wear and tear of the ledge member's cast mold and therefore extend the life of the mold.

5 Claims, 11 Drawing Sheets

TRIM SYSTEM

BACKGROUND OF THE INVENTION

1. Field of the Invention

The invention relates to trimming, more specifically, to a trim system for installing onto various surfaces.

2. Background of the Invention

Over the course of new building construction or renovations, it is desirable to install a trim or ledge system. A typical installation occurs where a wainscot application of stone is applied to the lower portion of the building face, and transition is required from one type of siding to another. A device suitable for easy installation that is also esthetically pleasing and allows for the proper flow of water away from the house wrap is essential.

Inventions such as U.S. Pat. No. 8,607,514 (Peterson), US Patent Publication No. 2012/0222383 (Cashman) have been devised in order to provide a trim system around a window to reduce water seepage and make it easy to install.

Specifically, Peterson discloses a snap fit system to be used with sealant, thereby creating the transition between the window sill and the trim. Unfortunately Peterson's system has many small and intricate parts, which can be lost or worse, broken. Meanwhile, Cashman's trim system discloses a C-shaped bracket and a trim piece with longitudinal slots to snap fit into the C-shaped bracket and complete the system.

Unfortunately, these devices are overly complicated and require many complex parts to provide the solution that is offered herein. Specifically, a device is required that can be simple, easy to install and further offer the ability to properly hide the fasteners so that it is aesthetically pleasing. The device further requires having a mold that can cast the proper part while preserving the mold's life. Moreover, screw-less systems have insufficient strength to hold heavy masonry components, and screw-less clip only systems are typically difficult to adjust or remove once component is installed. Finally, the geometry shown in Cashman would not be functional, as the flex required in leg to fit into slot would deform the steel component permanently. Once the component is screwed up against the brick mould of a window leg it will contact window mould and cannot be flexed to allow piece to clip in.

SUMMARY OF THE INVENTION

With specific reference to Cashman's device, advantages of the present invention include the fact that a J-component, rather than C-component allows for variance on width of cast component with a single steel C-component "sku" to install. J allows for rapid manufacturing of any conceivable profile and width of component to be installed without having to manufacture tooling for an exactly matching steel C-component.

In one aspect of the present invention, a trim system for use with brick or other masonry cladding is provided comprising a J-trim component for positioning onto a surface, said J-trim component having a hook portion; a ledge member to facilitate the egress of water, further comprised of: a slot along a longitudinal axis of the ledge member for positioning into the hook portion of the J-trim component; two leader grooves located on opposite extremities of the slot to reduce the degradation of a casting mould during fabrication of the ledge member; and at least two keyholes on a lower surface of the ledge member to secure said ledge member to the surface.

In a second aspect of the present invention, a ledge member to facilitate the egress of water is provided further comprised of: a slot along a longitudinal axis of the ledge member for positioning into the hook portion of the J-trim component; two leader grooves located on opposite extremities of the slot to reduce the degradation of a casting mould during fabrication of the ledge member; and at least two keyholes on a lower surface of the ledge member to secure said ledge member to the surface.

In a third aspect of the present invention, a keyhole to secure a component to a surface is provided, comprised of: a first pyramidal chamber positioned in the component to allow a screw body to fit therein, further comprised of tapered inner walls; a spherical chamber positioned adjacent to the first pyramidal chamber allow for a screw head to fit therein; and, a sloping hypotenuse travelling along the length of the first pyramidal chamber providing an optimal angle for a screw to secure the component to the surface.

BRIEF DESCRIPTION OF THE DRAWINGS

The following figures serve to illustrate various embodiments of features of the invention. These figures are illustrative and are not intended to be limiting.

DETAILED DESCRIPTION OF THE INVENTION

The following embodiments are merely illustrative and are not intended to be limiting. It will be appreciated that various modifications and/or alterations to the embodiments described herein may be made without departing from the invention and any modifications and/or alterations are within the scope of the contemplated invention.

Figure 1:
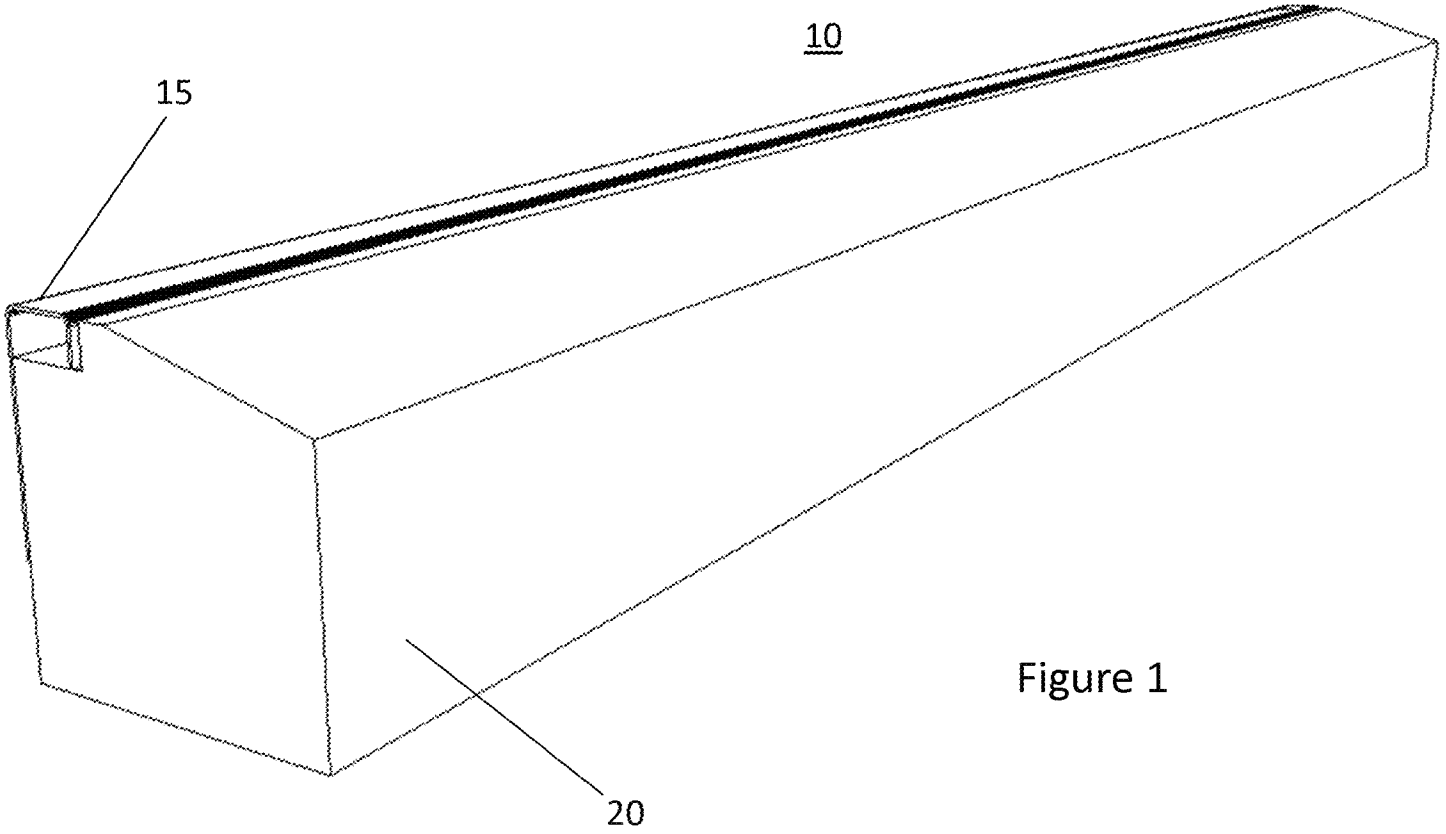
FIG. 1 is a perspective view of a trim system according to a first embodiment of the present invention.

With reference to FIG. 1 and according to a first embodiment of the present device, a trim system 10 is shown comprised of a J-trim component 15 and a ledge member 20 to facilitate the egress of water. The J-trim component 15 is meant to be positioned and then secured by means of screws onto a surface (not shown), for instance an exterior wall of a house. The ledge member 20 is then positioned and mates into the J-trim component 15 and is then screwed into the surface (not shown) by means of screws positioned into keyholes (not shown) of the ledge member 20. A sealant is also present but not shown, which will be positioned around the ledge member 20 and serves to protect the house wrap from dirt, dust and more specifically from water. The positioning and affixing to a surface is further detailed below. The purpose of the trim system 10 is to facilitate the transition between brick to another surface and allow water to properly flow from one to the other.

Figure 2:
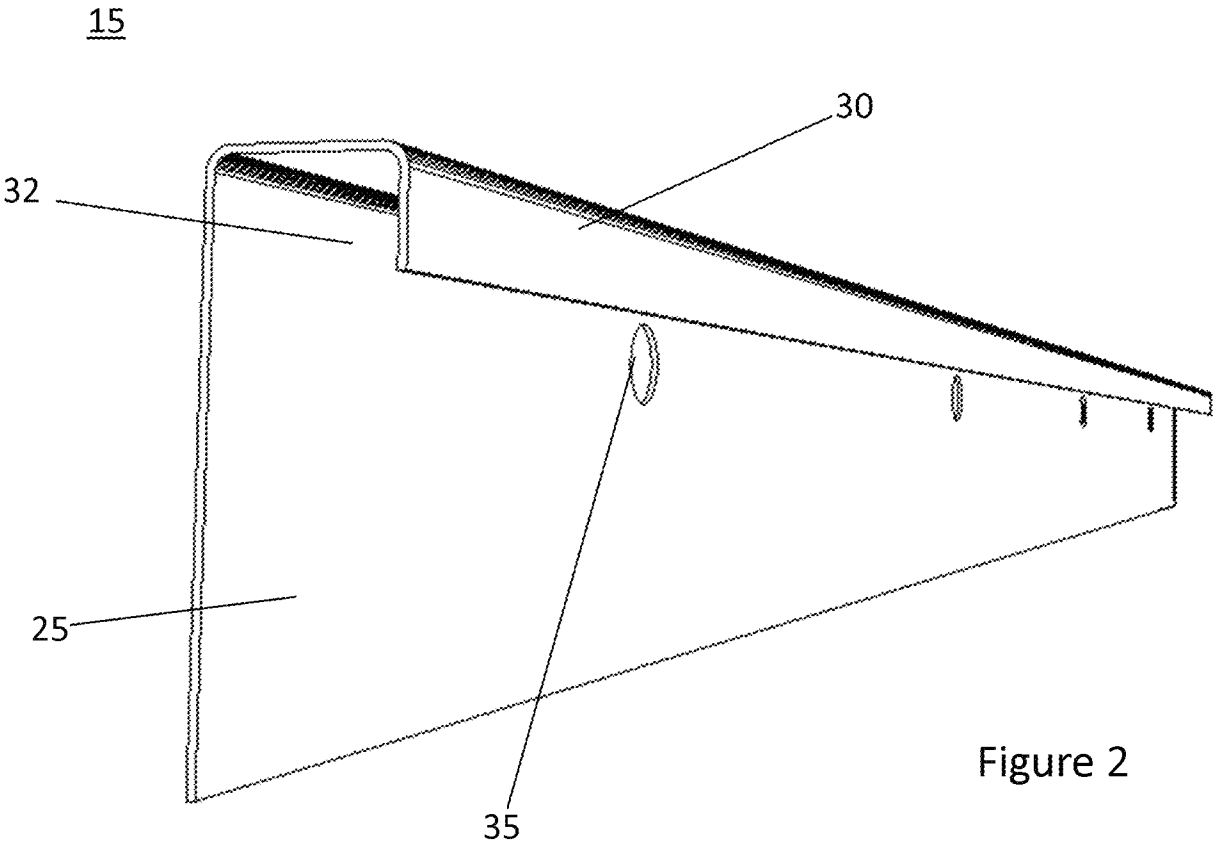
FIG. 2 is a perspective view of a J-trim component of the trim system according to a first embodiment of the present invention.

With reference to FIG. 2 and according to a first embodiment of the present invention, the J-trim component 15 is shown further comprised of a securing surface 25, and a hook portion 30 which defines a gap 32 between said hook portion 30 and the securing surface 25. In turn, the securing surface 25 is further comprised of at least two apertures 35 for receiving screws therein and securing the J-trim component 15 onto a surface. The hook portion 30 of the J-trim component 15 is shaped in such a way so as to mate with a slot (not shown) of the ledge member (not shown) while the gap 32 can fit a longitudinal strip (not shown) of the ledge member (not shown) within it. Therefore, in order to install the trim system onto a surface, the first step is comprised of positioning and securing the J-trim component 15 onto the surface by screwing screws into the apertures 35 located on the securing surface 25 of the J-trim component 15.

Figure 3A:
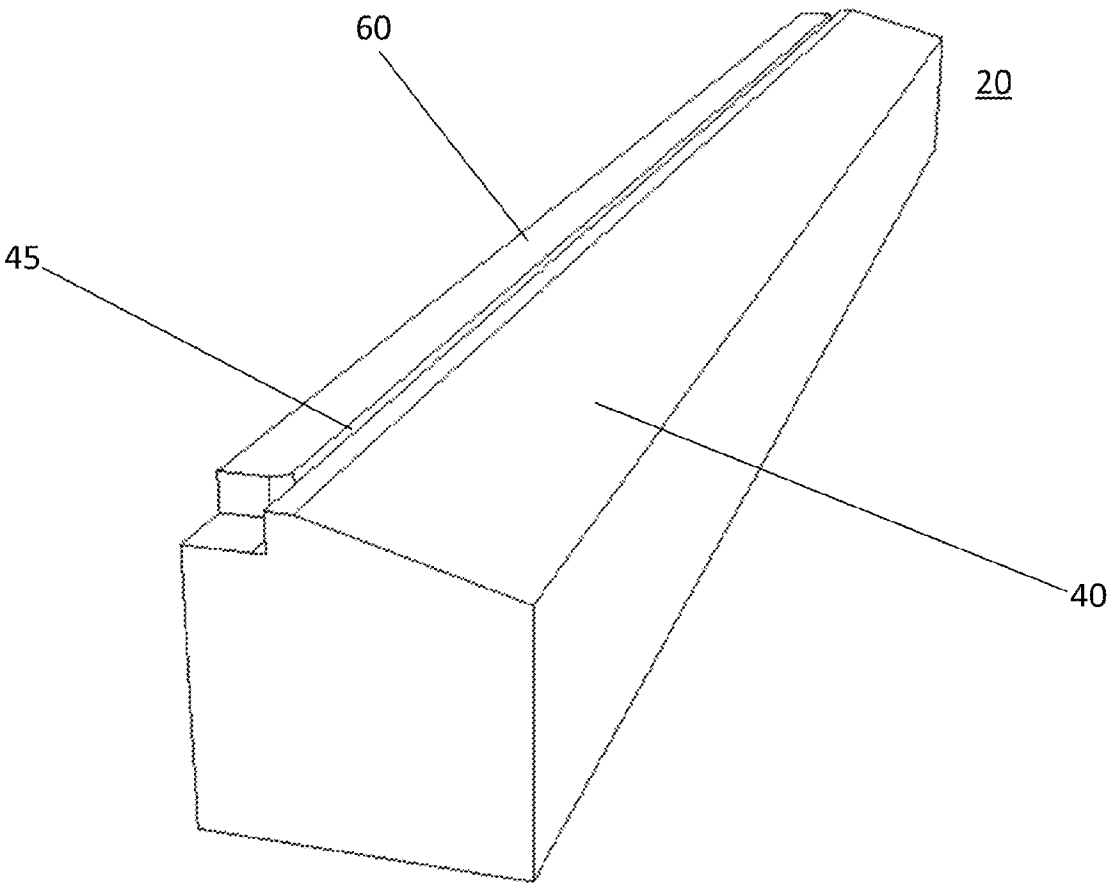
FIG. 3*a* is an upper perspective view of a ledge member of the trim system according to a first embodiment of the present invention.
Figure 3B:
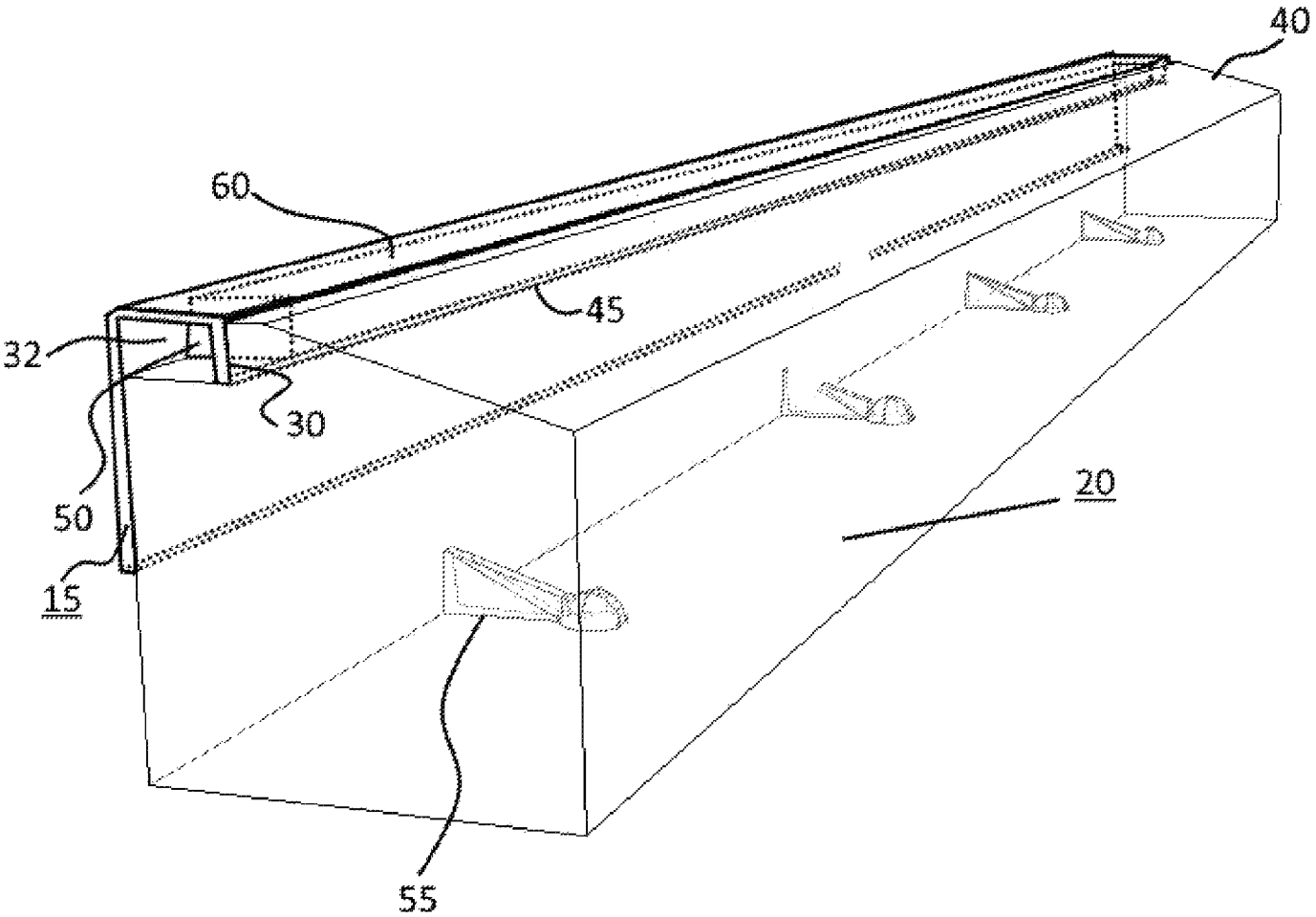
FIG. 3*b* is an upper perspective view of the trim system showing connection of the J-trim component and the ledge member according to a first embodiment of the present invention.
Figure 3C:
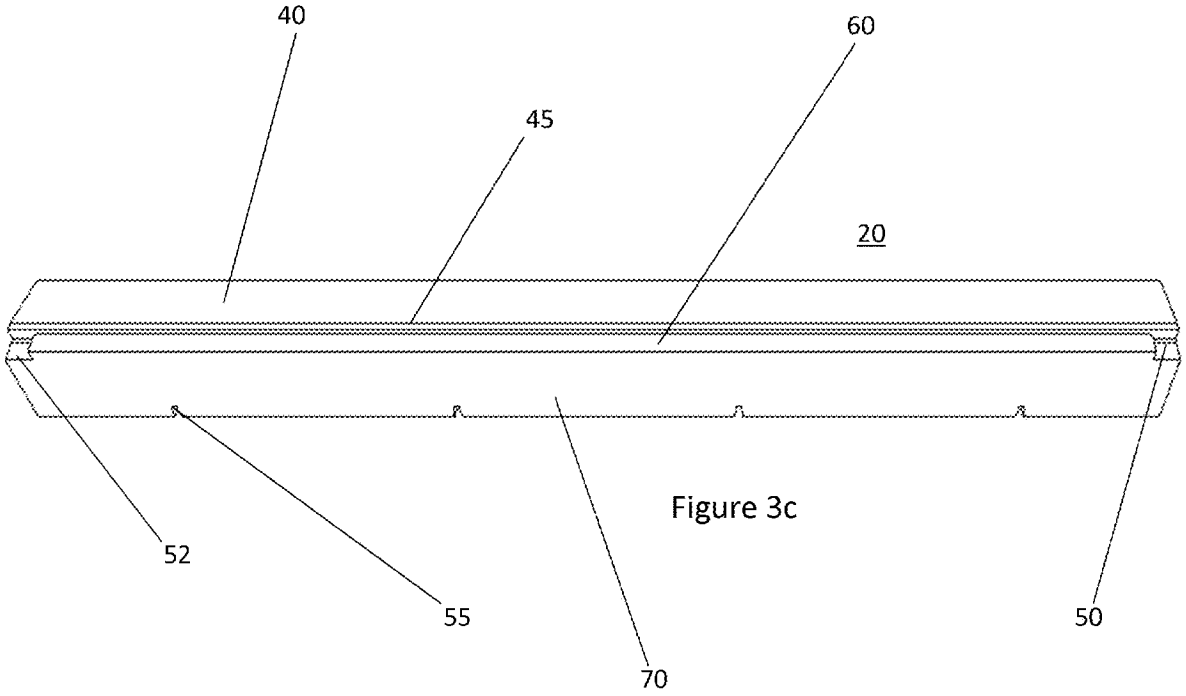
FIG. 3*c* is an upper rear perspective view of a ledge member of the trim system according to a first embodiment of the present invention.

With reference to FIGS. 3*a*, 3*b* and 3*c* and according to a first embodiment of the present invention, the ledge member 20 is shown comprised of a sloping surface 40, a slot 45 along a longitudinal axis of the ledge member 20, two leader grooves 50, 52 and at least two keyholes 55. The slot 45 which is along the longitudinal axis of the ledge member 20 is meant for positioning into the hook portion 30 (shown in FIG. 3*b*) of the J-trim component 15 (shown in FIG. 3*b*). It therefore follows that the width of a longitudinal strip 60 parallel to the slot 45 corresponds to the gap 32 (shown in FIG. 3*b*) of the J-trim component 15 (shown in FIG. 3*b*) for easy mating. The two leader grooves 50, 52 which are positioned on opposite extremities of the slot 45 will generally be flush with a first side surface 70 of the ledge member 20. As the ledge member 20 is a cast component, the two leader grooves 50, 52 are present in order to reduce the degradation of the cast mould. When the two leader grooves 50, 52 are not present in the trim system such that the longitudinal strip 60 runs parallel to the ledge of the first side surface 70, often the longitudinal strip 60 will cause the mould to break at each extremity of said longitudinal strip 60 when the ledge member 20 is being removed from the mould. Therefore, by terminating the longitudinal strip 60 in the two leader grooves 50, 52, the mould remains stronger at the edges of the longitudinal strip 60 and will resist to breaking when being removed from the mould, therefore prolonging the life of the mould. The ledge member 20 is further comprised of at least two keyholes 55 extending from a lower surface (not shown) to the first side surface 70 of the ledge member 20 for securing said ledge member 20 to the surface (not shown).

Figure 4A:
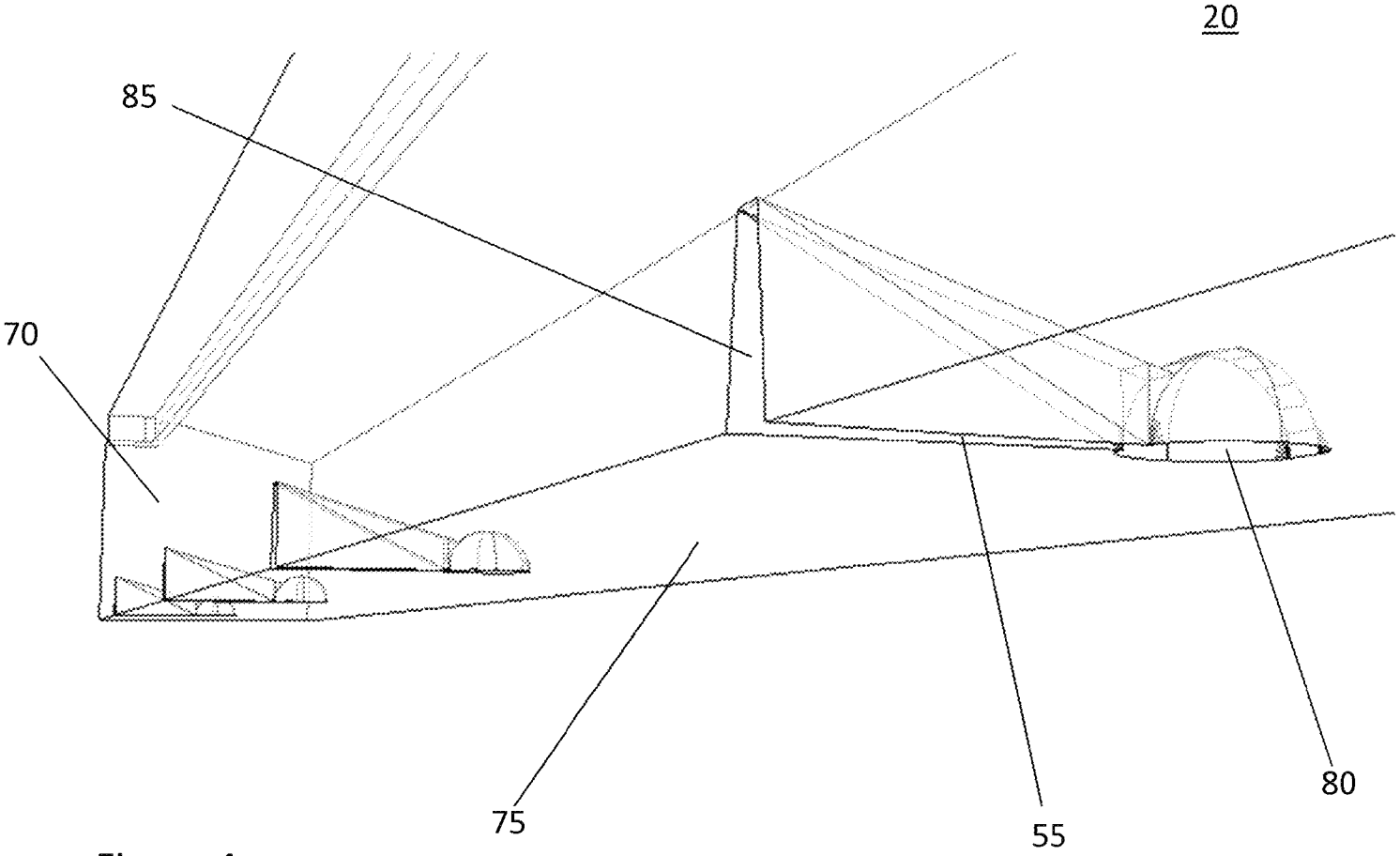
FIG. 4*a* is a lower perspective view of a transparent portion of a ledge member of the trim system according to a first embodiment of the present invention.
Figure 4B:
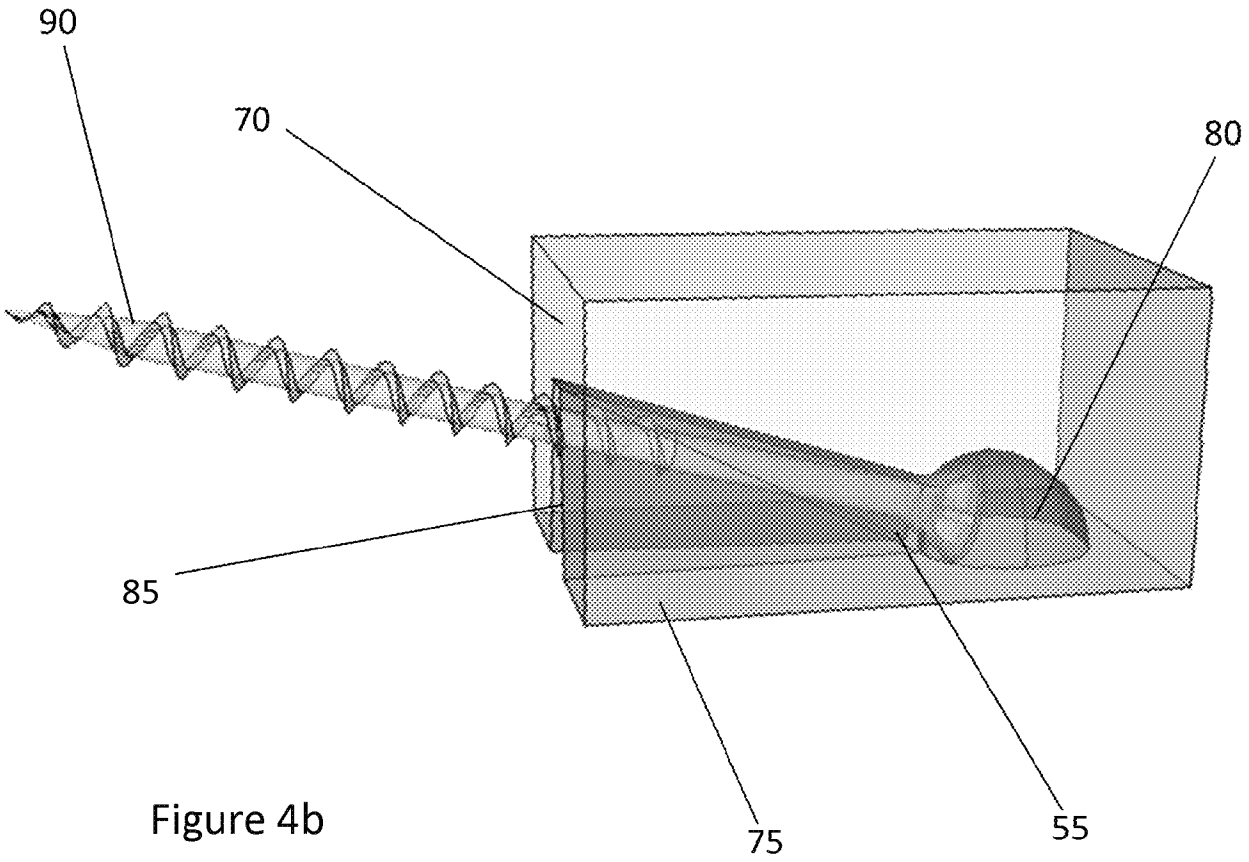
FIG. 4*b* is a cutaway perspective view of a keyhole of the trim system according to a first embodiment of the present invention.

With reference to FIGS. 4*a* and 4*b* and according to one embodiment of the present invention, the keyholes 55 are shown extending from a lower surface 75 to a first side surface 70 of the ledge member 20. The keyholes 55 are further comprised of a spherical chamber 80 and a pyramidal chamber 85, said spherical chamber 80 in order to allow for a screw 90 to be inserted within it, and then the pyramidal chamber 85 being angled in such a way so as to allow the screw 90 to screw into the surface (not shown) of the wall in an upwards angled fashion. The shape of the keyholes 55 allows for the screws 90 to be hidden from view yet still be functional in nature.

Figure 5A:
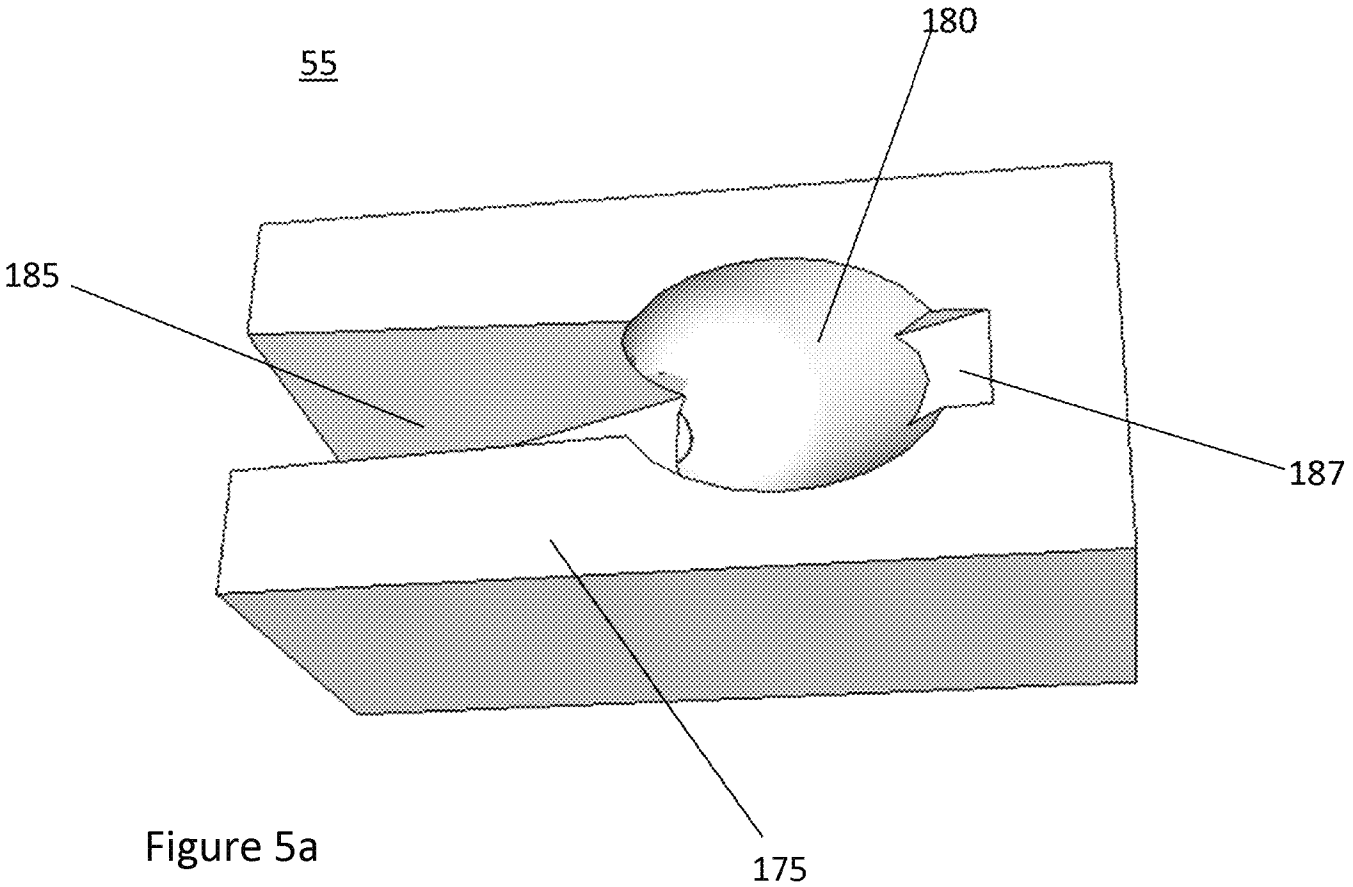
FIG. 5*a* is an upper perspective view of a keyhole of the trim system according to a second embodiment of the present invention.
Figure 5B:
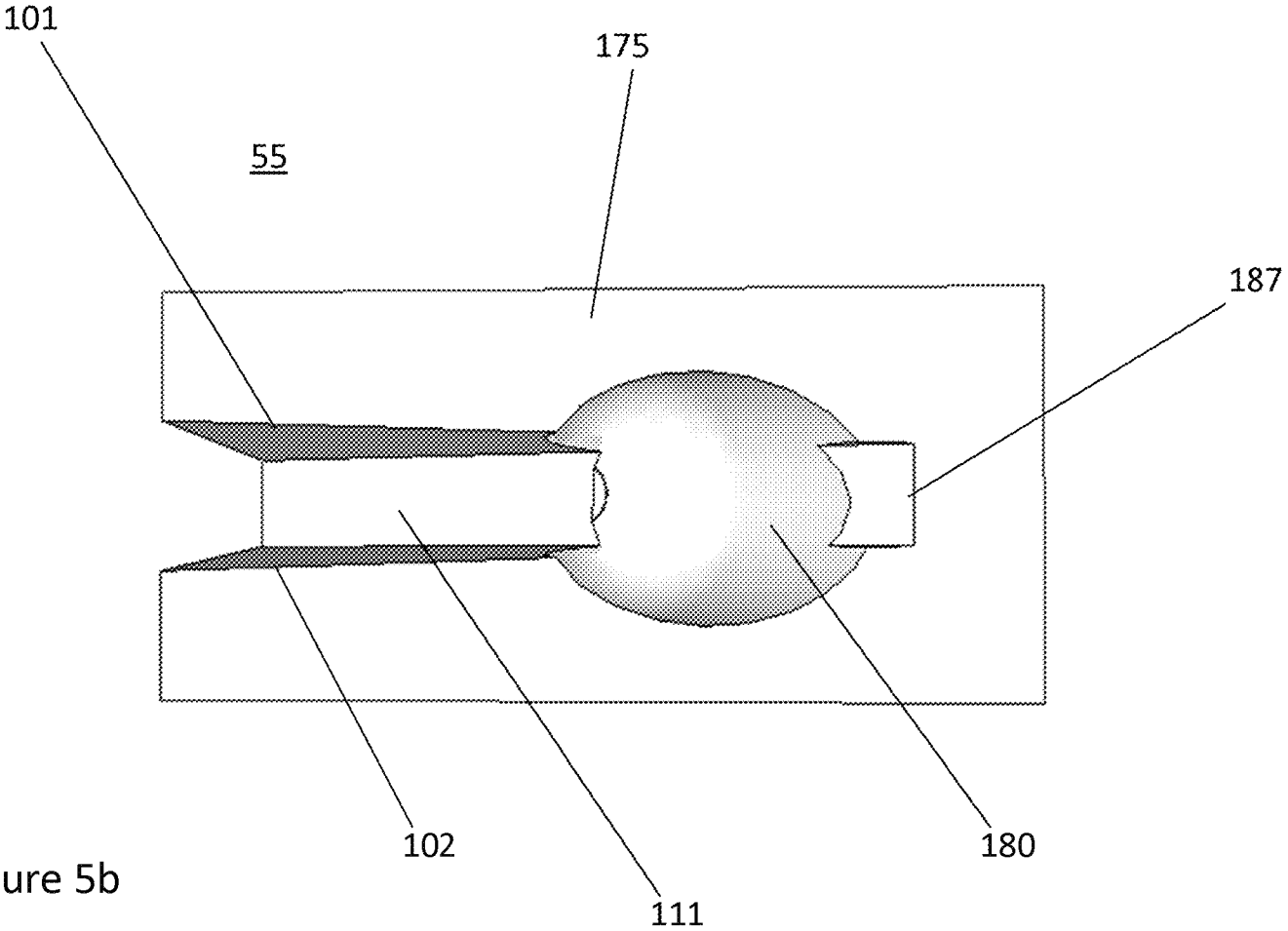
FIG. 5*b* is a top view of a keyhole of the trim system according to a second embodiment of the present invention.
Figure 5C:
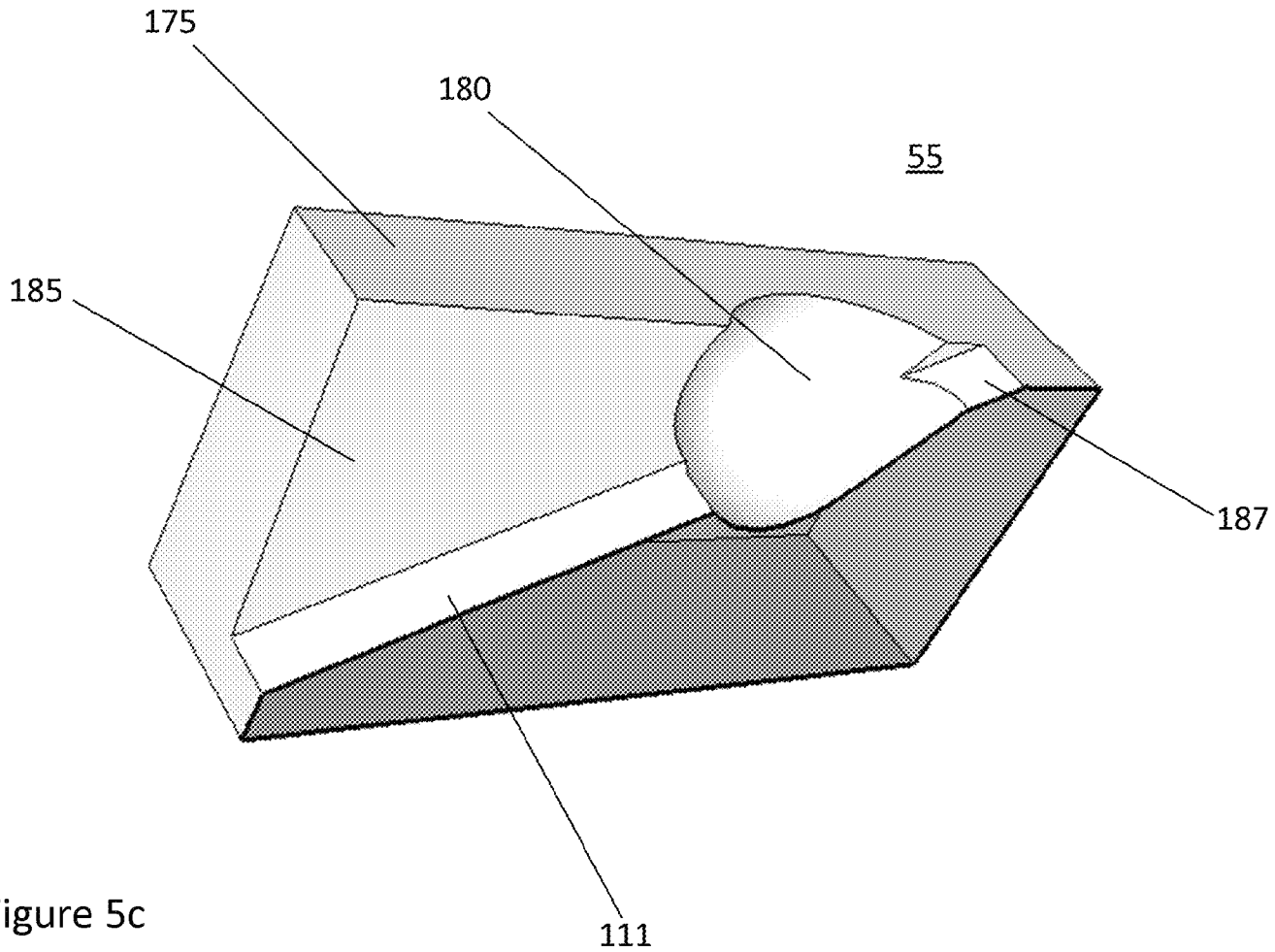
FIG. 5*c* is an upper perspective cross-sectional view of a keyhole of the trim system according to a second embodiment of the present invention.

With reference to FIGS. 5*a*, 5*b* and 5*c* and according to a second embodiment of the present invention, a keyhole 155 to secure a component to a surface is shown comprised of a first and second pyramidal chamber 185, 187 and a spherical chamber 180 positioned in between the first and second pyramidal chambers 185, 187. A worker skilled in the art would appreciate that while the present shape is spherical, it could be another suitable shape provided that is allows for the head of a screw to fit therein. The first pyramidal chamber 185 is positioned in a component and further comprised of tapered inner walls 101, 102 which are essential as they allow for the keyhole 155 to be properly removed from the mold during manufacturing. The tapered inner walls 101, 102 must taper inwardly from a lower surface 175 towards a sloping hypotenuse 111. Said sloping hypotenuse 111 travels along the length of the first and second chambers 185, 187 and will allow the screw to be angled with a certain inclination upwards and into another component, as was described above. Specifically, the sloping hypotenuse 111 should have an optimal angle which would correspond to an incline in between 15-30 degrees. This will allow the force that the screw will provide to be sufficient to hold the component. The second pyramidal chamber 187 is provided is some limited circumstances, depending on the size of the screw head/driver tip. When the screw head is smaller, the second pyramidal chamber 187 will be unnecessary.

Figure 6:
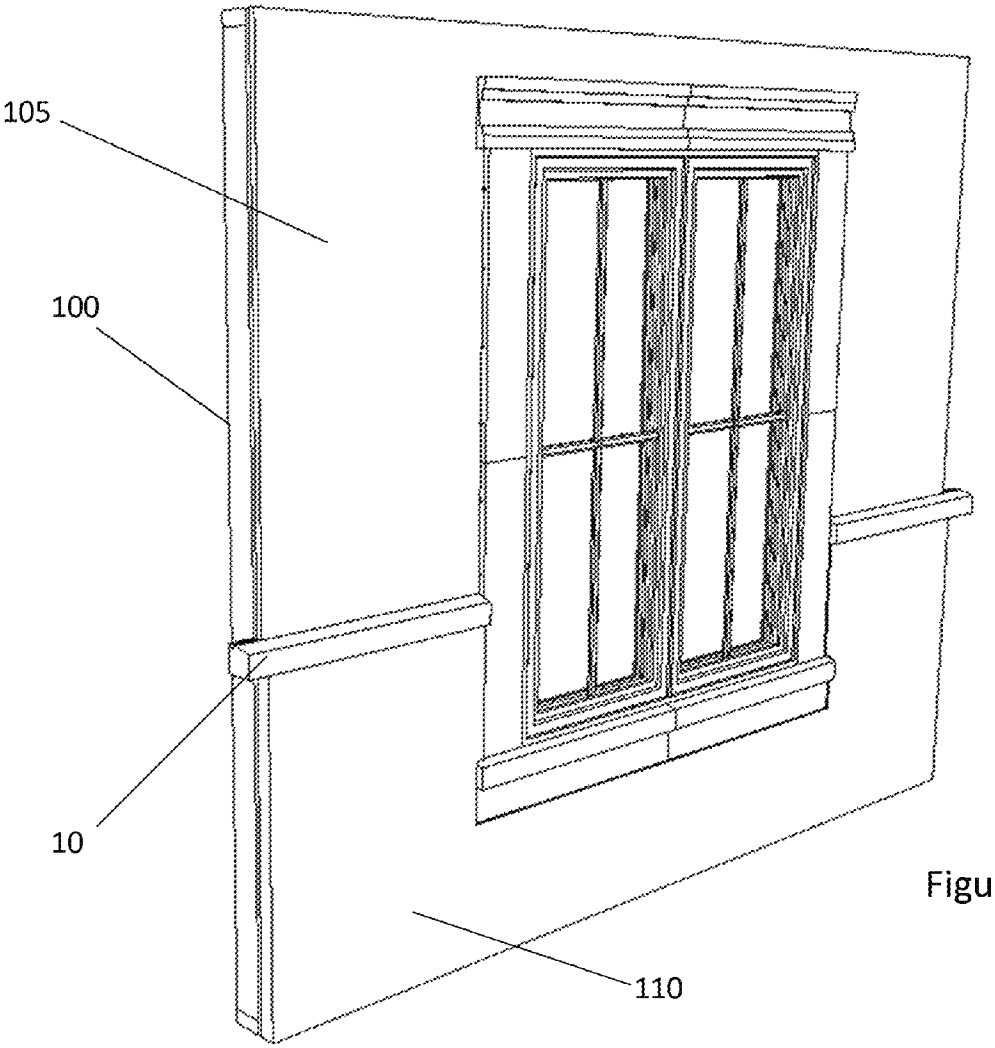
FIG. 6 is a perspective view of a trim system positioned and secured onto a surface of a home according to a first embodiment of the present invention.

With reference to FIG. 6 and according to a first embodiment of the present invention, the trim system 10 is shown affixed to a wall 10 of a house. As was previously explained, the trim system 10 separates a first plane 105 such as brick from a second plane 110 such as a different type of stone. A worker skilled in the art will appreciate that while the trim system 10 of the present embodiment is always shown installed horizontally, it is possible for this system to work vertically as well. As sealant will be used to protect the house wrap from the penetration by water, the orientation of the trim system 10 is immaterial to the teachings of the invention.

Many modifications of the embodiments described herein as well as other embodiments may be evident to a person skilled in the art having the benefit of the teachings presented in the foregoing description and associated drawings. It is understood that these modifications and additional embodiments are captured within the scope of the contemplated invention which is not to be limited to the specific embodiment disclosed.

We claim:

1. A trim system for use with brick or other masonry cladding comprising:

a. a J-trim component for positioning onto a surface, said J-trim component having a hook portion;

b. a ledge member to facilitate the egress of water, further comprised of:

i. a slot along a longitudinal axis of the ledge member for positioning into the hook portion of the J-trim component, wherein the slot has a first end and a second end;

ii. two leader grooves adjacent to the first and second ends of the slot to reduce the degradation of a casting mould during fabrication of the ledge member; and iii. at least two keyholes extending from a lower surface to a first side surface of the ledge member to secure said ledge member to the surface, wherein the keyholes are further comprised of a spherical chamber and pyramidal chamber.

2. The trim system of claim 1 wherein the two leader grooves adjacent to the first and second ends of the slot and extend to the first side surface of the ledge member.

3. The trim system of claim 1 wherein the ledge member is further comprised of a longitudinal strip for positioning in between the hook portion and a securing surface of the J-trim component.

4. The trim system of claim 3 wherein a distance in between the hook portion and the securing surface of the J-trim component is defined by a gap which receives the longitudinal strip of the ledge member, wherein the slot along a longitudinal axis of the ledge member receives the hook portion of the J-trim component when the gap receives the longitudinal strip.

5. The trim system of claim 1 wherein the J-trim component is further comprised of a securing surface comprised of at least two apertures for receiving screws therein for securing the J-trim component to a surface.

* * * * *